United States Patent [19]

Lopez

[11] 4,262,452

[45] Apr. 21, 1981

[54] DISC BRAKE GRINDING APPARATUS AND METHOD

[76] Inventor: Francisco R. Lopez, 406 E. California, Arcadia, Calif. 91006

[21] Appl. No.: 963,434

[22] Filed: Nov. 24, 1978

[51] Int. Cl.[2] ..... B24B 5/02

[52] U.S. Cl. ..... 51/89; 51/106 R; 51/281 SF

[58] Field of Search ..... 51/42, 88, 89, 104, 51/106 R, 111 R, 132, 170 PT, 179, 241 R, 241 S, 255, 258, 281 R, 281 SF, DIG. 3

[56] References Cited

U.S. PATENT DOCUMENTS

| | | | |
|---|---|---|---|
| 2,122,978 | 7/1938 | Eldridge et al. | 51/89 |
| 2,324,117 | 7/1943 | Strong | 51/42 |
| 2,545,659 | 3/1951 | Ginter | 51/170 PT |
| 2,575,212 | 11/1951 | Foster | 51/179 |
| 2,597,325 | 5/1952 | Hodges | 51/179 X |
| 2,938,306 | 5/1960 | Browne | 51/104 |
| 3,500,589 | 3/1970 | Ellege | 51/132 |
| 3,521,411 | 7/1970 | Henning et al. | 51/281 SF |
| 3,591,989 | 7/1971 | Granlre | 51/170 PT |
| 3,619,952 | 11/1971 | Leming et al. | 51/132 X |
| 3,621,505 | 11/1971 | Vocker et al. | 51/170 PT |

FOREIGN PATENT DOCUMENTS

| | | | |
|---|---|---|---|
| 612 | of 1859 | United Kingdom | 51/88 |

*Primary Examiner*—Gary L. Smith
*Assistant Examiner*—Robert P. Olszewski
*Attorney, Agent, or Firm*—William W. Haeflinger

[57] ABSTRACT

Rotors are located to engage opposite sides of a brake disc. One or both rotors is a grinding rotor and rotation of same accomplishes rapid finish treating of the disc. The rotors and a drive plus an actuator are supported by a hand held frame. An actuator effects relative movement of the rotors toward and away from one another.

19 Claims, 5 Drawing Figures

10
13
19
20
23
24
15
11
2
2
25
17
26
16
13
37a
3
37
38
38
37
34
32
40
42
40
47a
47
33
47a
3
72
71
72
4
4

40c
40a
40b
39
32
35
36
10
33a
34
80
44
43
43a
41
42
53
65
50
64
33a
59
66
61
58
57
60
48
51
69
62
57a
56
40
43
44a
44
71
70
52
153
33
72
5
5
64
153
69
33

DISC BRAKE GRINDING APPARATUS AND METHOD

BACKGROUND OF THE INVENTION

This invention relates generally to brakes, and more particularly concerns apparatus to clean or finish-treat the surfaces of disc brakes.

Automotive and other disc brakes commonly require cleaning as by lightly grinding their braking surfaces to remove deposits such as "glazing" which forms during friction braking at high temperatures. If not removed, such deposits can reduce braking efficiency, and can lead to objectionable squeaking. In the past, it was thought necessary to remove the braking disc from the wheel supporting it, in order to accomplish such cleaning. This procedure is time consuming and relatively expensive; accordingly, a need has existed for simple procedure and apparatus to accomplish the required cleaning, and preferably in a short time interval. However, no way was known to achieve this objective, in the simple and convenient manner, and with provision of apparatus in accordance with the present invention.

SUMMARY OF THE INVENTION

It is major object of the invention to provide method and apparatus overcoming the prior problems and disadvantages referred to above. Basically, the method of the invention involves employment of a pair of rotors at least one of which is a grinding rotor, and includes:

(a) rotating the disc while it is carried by its support, (b) locating the rotors at opposite sides of the disc, and (c) engaging the rotors with the disc opposite sides, and (d) rotating the grinding rotor.

Typically, both rotors are grinding rotors and are carried by a support frame, and the method includes releasably attaching or hooking that frame to a brake pad carrier frame prior to engaging the rotors with the disc opposite sides, whereby the rotors are accurately located relative to the disc, and the apparatus may be easily and rapidly manipulated by the user using only one hand.

The apparatus of invention basically comprises, in combination, (a) a pair of rotors, at least one of which is a grinding rotor, (b) means mounting the rotors to extend in spaced relation at opposite sides of a brake disc for grinding at least one such side, and for relative movement of at least one rotor toward and away from the disc, and (c) drive means to rotate at least one such rotor.

As will appear, the rotors may be frusto-conical and at least one of them is typically pivotally supported on the hand-held frame to pivot toward the other rotor. A spring may be used to urge both rotors toward one another, and they may be carried by pneumatic drive motors which pivot with the rotors. Further, a pneumatically responsive actuator may be employed to initially urge the rotors away from one another facilitating placement of the rotors on opposite sides of a disc and hooking of the frame to the brake pad carrier frame; and a manual control operates a valve to shift pneumatic pressure delivery from the actuator to the motors when grinding is to be initiated, as will be seen.

Finally, a disc drive is provided, employing an adapter plate that telescopically interfits fasteners that project from the disc, a drive motor drives the plate, and holders hold the plate to the disc during drive thereof.

These and other objects and advantages of the invention, as well as the details of an illustrative embodiment, will be more fully understood from the following description and drawings, in which:

DRAWING DESCRIPTION

DRAWING DESCRIPTION

Figure 1:
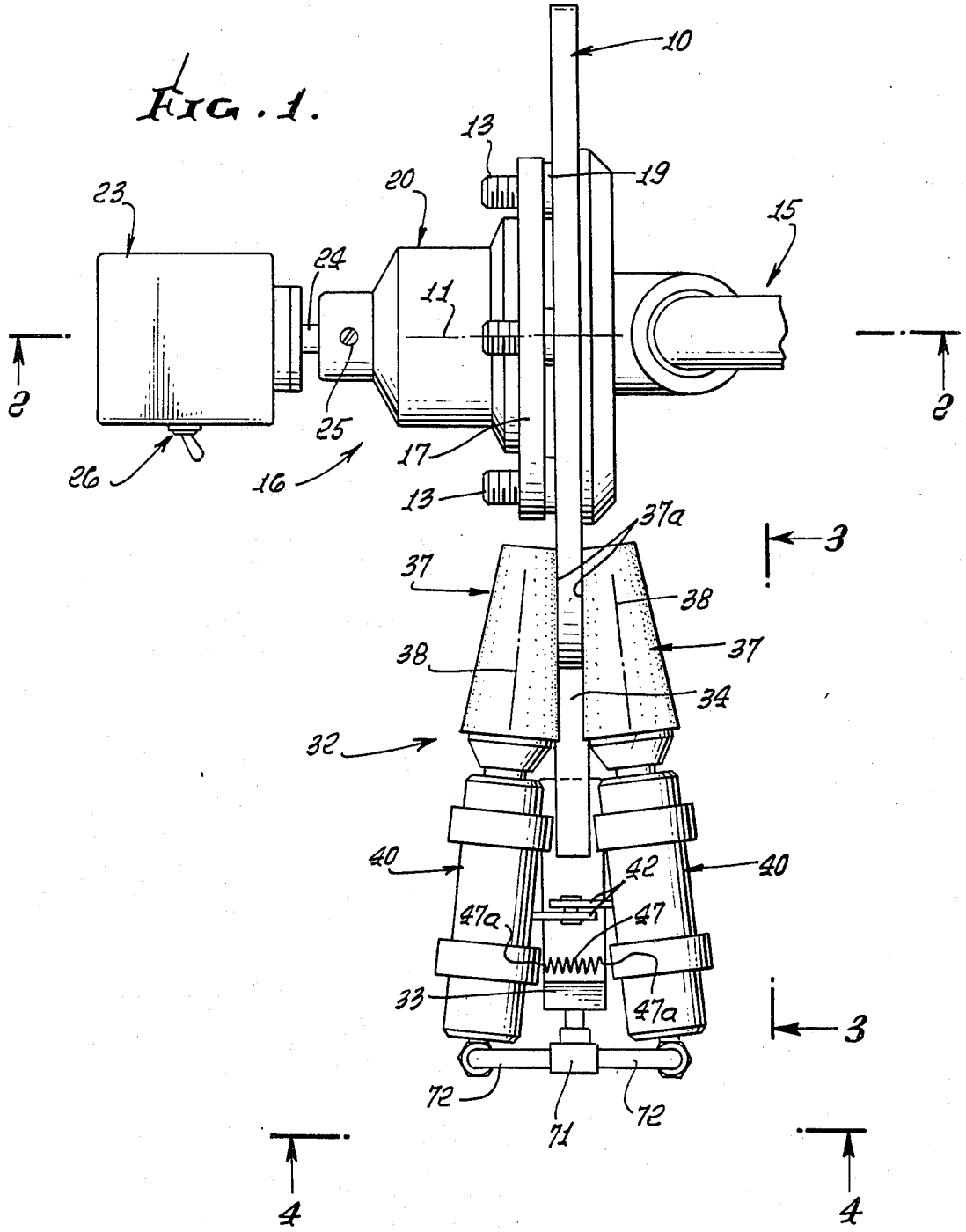
FIG. 1 is a plan view showing apparatus embodying the invention, in use.
Figure 2:
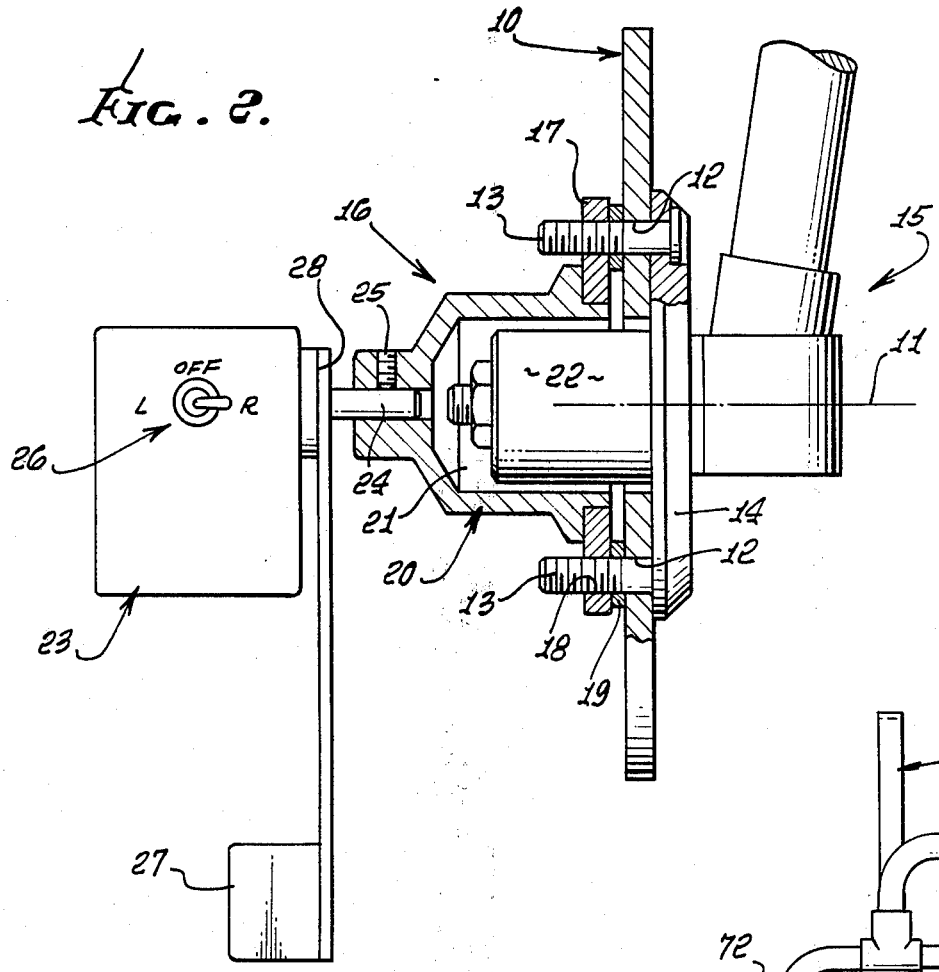
FIG. 2 is an elevation, in section, taken on lines 2—2 of FIG. 1.
Figures 3, 5:
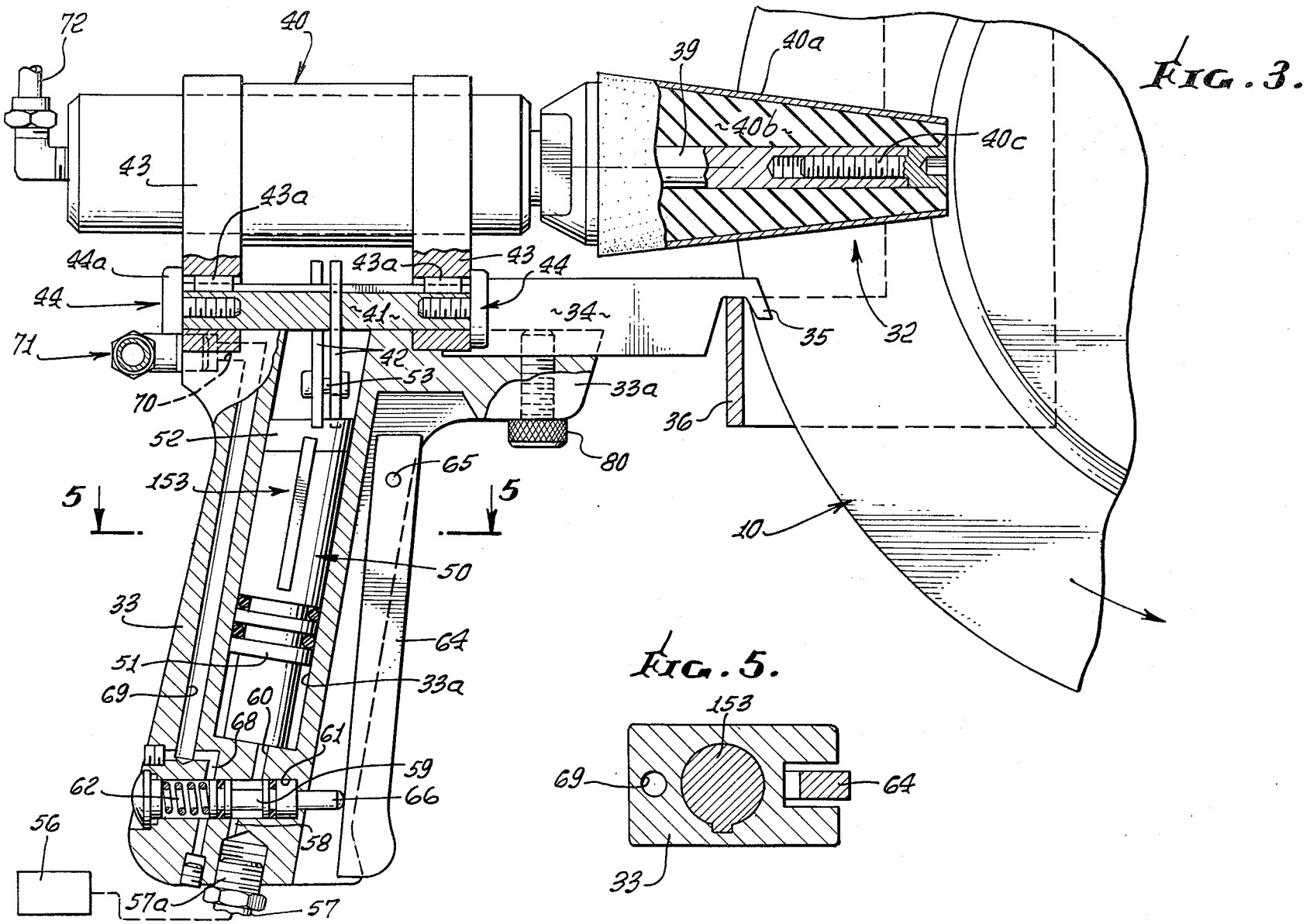
FIG. 3 is an enlarged side elevation taken on lines 3—3 of FIG. 1.
FIG. 5 is a horizontal section taken on lines 5—5 of FIG. 3.

In FIGS. 1 and 3, a brake disc is shown at 10 rotatable about axis 11. In the case of an automobile brake disc, it typically has several through openings 12 spaced about axis 11 and through which fasteners such as wheel bolts 13 project. The fasteners are carried by a rotor 14 to which vehicle wheel mount or strut 15 is attached, this being typical of a wheel which is not rotated by the automobile engine.

In order to rotate the wheel, drive means such as that at 16 is provided, and which is shown to include an annular adapter plate or part 17 having openings 18 to receive the bolts 13. Different plates with predetermined fastener opening arrangements may be used for corresponding disc bolt arrangements. Elements 19 are used to releasably attach the part 17 to disc 10, as shown. Elements 19 may consist of ceramic magnetic tape. Other elements could be used, such as nuts, split-nuts, and rubber grommets. The drive means also includes master hub 20 attached to part 17 and which is hollow at 21 to axially receive the wheel hub 22.

A drive motor 23 has an output shaft 24 attached, by set screw 25 (or other means), to hub 20 to rotate same, a motor ON-OFF and drive directional control being indicated at 26. Motor 23 may be electrically powered (as for example a gearmotor) and a weight 27 is attached at 28 to the motor case to resist counter-rotation of the case. Accordingly, a simple, lightweight, easily attached drive means is provided to rotate disc 10 in either direction in the case where it is not otherwise rotatable. Thus, either left or right side auto wheel brake discs may be rotated. The drive means is of course not required for brake discs of automobile wheels which are normally driven by the automobile engine and transmission system, the latter being employed to rotate such discs.

It will be noted that fasteners 13 and plate 17 are spaced radially inwardly from the disc faces to be ground.

In accordance with an important aspect of the invention, apparatus to grind either or both sides of the rotated disc (as for example to clean same) includes a pair of rotors at least one of which is a grinding rotor, means mounting the rotors to extend in spaced relation at opposite sides of the brake disc for grinding one or both such sides, and for relative movement of at least one rotor toward and away from the disc. Also, means to rotate at least one of such rotors may typically be provided.

In the illustrated "grinding gun" example, a hand-held frame 32 includes a pistol-grip hand portion 33 which projects generally downwardly from a forwardly extending frame portion 34 terminating at a forward hook 35. The latter hooks over or attaches to the brake pad carrier frame or caliper 36, as appears in FIG. 3, to hold the tool in position for grinding of one or both faces of disc 10. The frame portion 34 is adjustable forwardly and rearwardly to accommodate the hook to different positions of frames 36, clamp bolt 80 on frame extension 33*a* engaging portion 34 for this purpose.

The tool as shown includes two such rotors 37 which are alike, and which have axes of rotation 38 which taper forwardly. Each rotor is frusto-conical and has a slant height region 37*a* (as viewed in FIG. 1) generally parallel to the plane of the disc side which it engages. Also, both rotors are shown as grinding rotors, i.e. each has a frusto-conical abrasive surface as provided by a replaceable frusto-conical sheet 40*a* received on a rotor body 40*b*. The rotors are advantageously carried on the output shafts or elements 39 of motors 40 which are shown as pneumatic motors. FIG. 3 also shows that elements 39 carry the rotor bodies 40*b*, as well as fasteners 40*c* attaching the bodies to the shafts, and expanding the bodies into forcible engagement with conical sheets 40*a*.

The mounting means for the rotors, and also for the motors, includes pivot means on the frame supporting at least one rotor to pivot relative to the frame. Two such pivot means (one for each rotor and its drive motor) one shown in the drawings; thus, the pivot means may advantageously comprise two pivot pins 41 each connected between frame links or arms 42 and motor support links or arms 43. As shown, pins 41 are keyed at 43*a* to arm 43, and arms 42 swivel about a pivot 53. Tightenable fasteners 44 threadably attached to opposite ends of the pins, have heads 44*a* which engage the arms 43 to lock them in position. Arms 43 are attached to the motors 40, and arms 42 are integral with pins 41.

Figure 4:
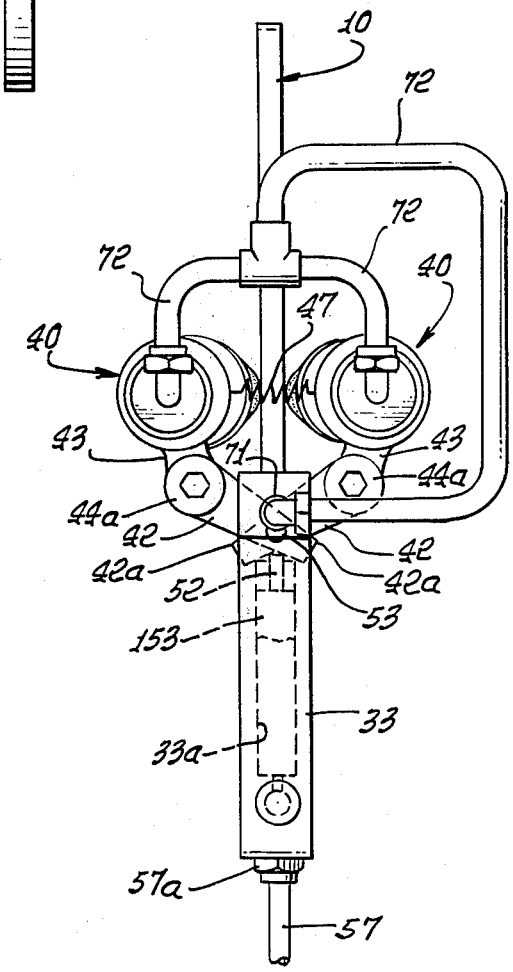
FIG. 4 is an end elevation taken on lines 4—4 of FIG. 1.

Also provided is yieldable means operable to urge rotors 37 relatively toward one another. Such means is shown in FIGS. 1 and 4 to comprise a tension spring 47 located between the pneumatic motors 40, and having opposite ends 47*a* attached to the motor cases. The spring tension is such as to urge the rotors 37 toward opposite faces of the disc 10, and to engage same with sufficient force as to effect desired cleaning of the discs when the disc is rotated. Such cleaning serves to remove any brake pad build-up on the discs, such as "glazing" which causes brake squeak.

A further aspect of the invention concerns the provision of an actuator to initially urge the rotors relatively away from one another, so as to easily embrace the disc 10. One highly advantageous actuator for this purpose comprises a pusher 50 which is pneumatically urged, and which includes a piston 51 in handle bore 33*a*, a pusher element 52 and structure 153 connecting the piston and element 52. The latter extends between the lower ends 42*a* of arms 42, as best seen in FIG. 4, the arms being pivoted to the frame at 53. When air pressure is applied to the piston, it moves element 52 upward to engage and rotate arm lower ends 42*a* in directions acting to relatively separate the rotors.

Air pressure is initially supplied to the piston 51 via source 56, line 57 connected at 57*a* to the lower end of the handle 33, duct 58, spool valve 59, and duct 60. Spool valve 59 moves in bore 61, and a spring 62 urges the valve toward its position shown in FIG. 3, in which air pressure is supplied to piston 51. At this time, the rotors are spread apart, and easily positioned at opposite sides of disc 10, allowing hook 35 to be placed over structure 36.

A trigger 64 is pivoted to the handle 33 at 65, and engages a plunger 66 projecting from valve spool 59. When the trigger is manually pulled rearwardly, it displaces spool valve 59 rearwardly to cut off air pressure communication to the piston, allowing the spring 47 to pull the grinding rotors 33 into the opposite side engagement with rotating disc 10; at the same time, the displaced valve now allows air pressure communication to the motors 40, to effect their rotation so as to rotate the rotors 33. Thus, air pressure is communicated from the valve 59 to ducts 68–70 in the handle, fitting 71 to exterior lines 72 leading to the air motors. Accordingly, the air motors are driven at the time that the tool is applied to the work, the same air pressure source being employed to initially displace the rotors, and later to drive the motors and grinding rotors, under the influence of a simple manual control.

After removal of the tool from the re-established disc surfaces, the brake pads are installed for job completion. Such pads were initially removed from the carrier frame or caliper, to gain access to the disc 10.

I claim:

1. In apparatus to grind a disc brake disc, the combination comprising:

(a) a pair of rotors, at least one of which is a grinding rotor, (b) means mounting the rotors to extend in spaced relation at opposite sides of a brake disc for grinding at least one such side, and for relative movement of at least one rotor toward and away from the disc, (c) drive means to rotate at least one of said rotors, (d) yieldable means operable to urge said rotors relatively toward one another, (e) actuator means to initially urge the rotors relatively away from one another, and (f) control means operatively connected to said actuator means and said drive means to cause the actuator means to allow said yieldable means to displace the rotors relatively toward one another and to then effect operation of said drive means.

2. The combination of claim 1 wherein said rotors are each frusto-conicai, with slant height regions generally parallel to opposite sides of the disc.

3. The combination of claim 1 wherein said mounting means includes a hand-held frame and first pivot means on the frame supporting at least one rotor to pivot relative to the frame.

4. The combination of claim 3 wherein said mounting means includes second pivot means on the frame, supporting the other rotor to pivot relative to the frame.

5. The combination of claim 2 wherein said mounting means includes a hand-held frame and first pivot means on the frame supporting at least one rotor to pivot relative to the frame.

6. The combination of claim 5 wherein said mounting means includes second pivot means on the frame, supporting the other rotor to pivot relative to the frame.

7. The combination of claim 1 wherein said drive means includes pneumatic motor means to rotate both rotors.

8. The combination of claim 7 wherein said actuator means includes a pneumatically responsive actuator connected to said motor means.

9. In apparatus to grind a disc brake disc, the combination comprising:

(a) a pair of rotors, at least one of which is a grinding rotor, (b) means including a frame mounting the rotors to extend in spaced relation at opposite sides of a brake disc for grinding at least one such side, and for relative movement of at least one rotor toward and away from the disc, (c) means including pneumatic motor means to rotate at least one of said rotors, (d) yieldable means operable to urge said rotors relatively toward one another, (e) a pneumatically responsive actuator to initially urge the rotors relatively away from one another, (f) a manual control on the frame, a control valve on the frame operatively connected to said manual control, the valve having a first position in which pneumatic pressure is communicated via the valve to said actuator, and a second position in which pneumatic pressure is communicated to said pneumatic motor means.

10. The combination of claim 9 wherein said motor means include two pneumatic motors respectively carrying said rotors.

11. The combination of claim 10 wherein said motors are pivotally attached to said frame.

12. The combination of claim 3 including a hook on said frame to attach to a brake pad carrier frame.

13. The combination of claim 12 including said carrier frame to which said apparatus is attached via said hook with said rotors straddling the disc, and including means to rotate the disc.

14. In apparatus to grind a disc brake disc, the combination comprising:

(a) a pair of rotors, at least one of which is a grinding rotor, (b) means mounting the rotors to extend in spaced relation at opposite sides of a brake disc for grinding at least one such side, and for relative movement of at least one rotor toward and away from the disc, and (c) means to rotate at least one of said rotors, (d) said mounting means including a hand-held frame and first pivot means on the frame supporting at least one rotor to pivot relative to the frame, (e) a hook on the frame to attach to a brake pad carrier frame, and including said carrier frame to which said apparatus is attached via said hook with said rotors straddling the disc, and means to rotate the disc including an adapter plate telescopically interfitting fasteners projecting from the disc, a drive motor, and structure connecting the drive motor to the adapter plate.

15. The combination of claim 14 including holders to hold the adapter plate to the disc.

16. The method of grinding a wheel braking disc, and employing a pair of rotors at least one of which is a grinding rotor, that includes (a) rotating the disc while it is carried by its support, (b) locating the rotors at opposite sides of the disc, and also positively urging the rotors relatively away from one another, (c) discontinuing said positive urging of the rotors and yieldably urging the rotors relatively toward one another for engaging the rotors with the disc opposite sides, and (d) rotating the grinding rotor, (e) the rotors being carried by a support frame, and including the step of locating said support frame in a supported position relative to a brake pad carrier frame prior to engaging the rotor with the disc opposite sides.

17. The method of grinding a wheel braking disc, and employing a pair of rotors at least one of which is grinding rotor, that includes (a) rotating the disc while it is carried by its support, (b) locating the rotors at opposite sides of the disc, and (c) engaging the rotors with the disc opposite sides, and (d) rotating the grinding rotor, (e) the rotors being carried by a support frame, and including the step of pivotally attaching said support frame to a brake pad carrier frame prior to engaging the rotor with the disc opposite sides.

18. The method of claim 17 wherein both rotors are grinding rotors, and including the step of pneumatically rotating both rotors while they are in engagement with the disc opposite sides.

19. In apparatus, (a) a pair of rotors, at least one of which is a grinding rotor, (b) means mounting the rotors to extend in spaced relation at opposite sides of a brake disc for grinding at least one such side, and for relative movement of at least one rotor toward and away from the disc, (c) said mounting means including a hand-held frame and first pivot means on the frame supporting at least one rotor to pivot relative to the frame, (d) spring means yieldably urging the rotors relatively toward one another, (e) pneumatically responsive actuator means on the frame to initially urge the rotors relatively away from one another, (f) drive means to rotate the grinding rotor, and (g) control means operatively connected with said actuator means and said drive means to first cause the actuator means to allow said spring means to displace the rotors relatively toward one another to engage opposite sides of the disc, and then to effect operation of the drive means.

* * * * *